US007762809B2

(12) United States Patent
Takahashi et al.

(10) Patent No.: US 7,762,809 B2
(45) Date of Patent: Jul. 27, 2010

(54) HEAT TREATMENT APPARATUS

(75) Inventors: Kiichi Takahashi, Oshu (JP); Yuichiro Sase, Oshu (JP); Izumi Sato, Oshu (JP); Kiyohiko Takahashi, Oshu (JP)

(73) Assignee: Tokyo Electron Limited, Tokyo (JP)

( * ) Notice: Subject to any disclaimer, the term of this patent is extended or adjusted under 35 U.S.C. 154(b) by 280 days.

(21) Appl. No.: 11/907,517

(22) Filed: Oct. 12, 2007

(65) Prior Publication Data

US 2008/0090195 A1 Apr. 17, 2008

(30) Foreign Application Priority Data

Oct. 13, 2006 (JP) ..... 2006-280082
Dec. 22, 2006 (JP) ..... 2006-346363
Aug. 20, 2007 (JP) ..... 2007-213492

(51) Int. Cl.
*F27D 1/18* (2006.01)

(52) U.S. Cl. ..... 432/242; 432/251

(58) Field of Classification Search ..... 432/241, 432/242, 244, 245, 247, 251
See application file for complete search history.

(56) References Cited

U.S. PATENT DOCUMENTS 5,207,573 A * 5/1993 Miyagi et al. ..... 432/182
5,252,062 A * 10/1993 Groves et al. ..... 432/205
5,368,648 A * 11/1994 Sekizuka ..... 118/733
5,578,132 A * 11/1996 Yamaga et al. ..... 118/724
5,662,470 A * 9/1997 Huussen et al. ..... 432/241
5,902,406 A * 5/1999 Uchiyama et al. ..... 118/724
5,908,292 A * 6/1999 Smith et al. ..... 432/197
5,947,718 A * 9/1999 Weaver ..... 432/77
5,951,282 A * 9/1999 Sakata et al. ..... 432/241
6,142,773 A * 11/2000 Shimazu ..... 432/241
6,283,175 B1 * 9/2001 Shimazu ..... 141/98
6,709,525 B2 * 3/2004 Song ..... 118/733
6,988,886 B2 * 1/2006 Takata et al. ..... 432/242
2002/0023458 A1 * 2/2002 Sakata et al. ..... 62/378
2008/0083109 A1 * 4/2008 Shibata et al. ..... 29/428
2008/0090195 A1 * 4/2008 Takahashi et al. ..... 432/250

FOREIGN PATENT DOCUMENTS

JP 2001-237238 8/2001

* cited by examiner

*Primary Examiner*—Gregory A Wilson
(74) *Attorney, Agent, or Firm*—Smith, Gambrell & Russell, LLP

(57) ABSTRACT

Disclosed is a heat treatment apparatus which includes a processing vessel having a furnace throat at its bottom and adapted to accommodate process objects therein to perform a heat treatment to the process objects under reduced pressure, the processing vessel having a vessel main body made of quartz, a metallic lid adapted to support thereon a holder for holding a plurality of process objects so as to load and unload the holder into and from the processing vessel and to close and open the furnace throat, and an annular sealing member disposed on the lid to seal a gap between the lid and the furnace throat. A contact-preventing member is disposed between the lid and the furnace throat to prevent contact of the lid with the furnace throat due to squashing of the sealing member that would otherwise occur when an internal pressure of the processing vessel is reduced.

8 Claims, 9 Drawing Sheets

-- Prior Art --

-- Prior Art --

HEAT TREATMENT APPARATUS

TECHNICAL FIELD

The present invention relates to a heat treatment apparatus.

BACKGROUND ART

In manufacturing of semiconductor devices, various processing apparatuses (semiconductor-manufacturing apparatuses) are used to perform various processes, such as oxidizing, diffusing and CVD (Chemical Vapor Deposition), to process objects, such as semiconductor wafers (hereinafter, also referred to simply as "wafers"). As one type of such processing apparatuses, there has been known a batch-type heat treatment apparatus (e.g., a vertical heat treatment apparatus) that performs a heat treatment (thermal process) to a large number of wafers at a time (refer to JP2001-237238A, for example).

One example of the vertical heat treatment apparatus is a low-pressure diffusion apparatus, part of which is shown in FIG. 13. The low-pressure diffusion apparatus of FIG. 13 includes: a processing vessel 3 (process tube) made of quartz that accommodates wafers therein to perform a heat treatment to the wafers under reduced pressure; a metallic lid 15 that supports thereon a not shown holder (wafer boat) for holding a large number of wafers so as to load and unload the holder into and from the processing vessel 3 and to close and open the furnace throat 2*a*; and an O-ring 32 (annular sealing member) disposed on the peripheral portion of the lid 15 to seal a gap between the lid 15 and the furnace throat 2*a* of the processing vessel 3 (specifically, furnace throat flange 3*a*).

Another example of the vertical heat treatment apparatus is a low-pressure CVD apparatus, part of which is shown in FIG. 14. The low-pressure CVD apparatus of FIG. 14 includes: a processing vessel (not shown) made of quartz having a lower opening that accommodates wafers therein to perform a heat treatment to the wafers under reduced pressure; a metallic manifold (throat member) 50 connected to the lower portion of the processing vessel to provide a furnace throat 2*a*; a metallic lid 15 that supports thereon a not shown holder (wafer boat) for holding a large number of wafers so as to load and unload the holder into and from the processing vessel 3 and to close and open the furnace throat 2*a*; and an O-ring 32 disposed on the peripheral portion of the lid 15 to seal a gap between the lid 15 and the manifold 50.

In the former heat treatment apparatus shown in FIG. 13, when the internal pressure of the processing vessel 3 is reduced, the O-ring 32 between the lid 15 and the furnace throat 2*a* (more specifically, the throat flange 3*a*) is squashed so that direct contact between the lid 15 and the throat 2*a* occurs. Due to this, contact pressure is exerted on the furnace throat 2*a*, resulting in damage of the furnace throat 2*a* such as cracking, and generation of particles due to micro cracks.

In the latter heat treatment apparatus shown in FIG. 14, when the internal pressure of the processing vessel 3 is reduced, the O-ring 32 between the lid 15 and the manifold 50 is also squashed so that direct contact between the lid 15 and the manifold 50 occurs. This causes chafing between the lid 15 and the manifold 50 due to difference in their thermal expansions, resulting in metallic contamination of wafers.

SUMMARY OF THE INVENTION

The present invention has been made in view of the foregoing problems, and therefore the object of the invention is to provide a heat treatment apparatus capable of preventing direct contact between a lid and a furnace throat or a furnace throat member due to squashing of a sealing member disposed therebetween under reduced pressure, and of preventing damage, such as cracking, of the furnace throat, or chafing between the lid and the throat member.

In order to achieve the above objective, the present invention provides a heat treatment apparatus, which includes: a processing vessel adapted to accommodate process objects therein to perform a heat treatment to the process objects under reduced pressure, the processing vessel having a furnace throat at a bottom thereof and the processing vessel having a vessel main body made of quartz; a metallic lid adapted to support thereon a holder for holding a plurality of process objects so as to load and unload the holder into and from the processing vessel and to close and open the furnace throat; and an annular sealing member disposed on the lid to seal a gap between the lid and the furnace throat, wherein a contact-preventing member is disposed between the lid and the furnace throat to prevent contact of the lid with the furnace throat due to squashing of the sealing member that would otherwise occur when an internal pressure of the processing vessel is reduced.

In one embodiment, the processing vessel has a metallic throat member connected to a lower portion of the vessel main body to provide the furnace throat.

In another embodiment, the processing vessel is constituted such that a lower end portion of the vessel main body made of quartz provides the furnace throat.

The contact-preventing member may be disposed outside the sealing member. Alternatively, the contact-preventing member may be disposed inside the sealing member.

According to the present invention, direct contact between the lid and the furnace throat due to the squashing of the sealing member between the lid and the throat under reduced pressure can be prevented. Thus, damage, such as cracking, of the furnace throat can be prevented, resulting in a longer working life of the processing vessel. In addition, chafing between the lid and the throat member can be prevented, and thus metallic contamination of the process objects due to the chafing can be prevented.

Preferably, the contact-preventing member has an annular shape and has a cutout to absorb circumferential thermal expansion of the contact-preventing member. Due to the annular configuration, the compressive load exerted on the contact-preventing member is distributed so that the contact-preventing member can withstand the compressive load; and due to the provision of the cutout, the circumferential thermal expansion of the contact-preventing member can be well absorbed. Thereby, a longer life of the contact-preventing member and the processing vessel can be achieved.

Preferably, an engagement projection, for preventing disengagement of the contact-preventing member from the lid, is formed at a lower portion of the contact-preventing member, the engagement projection extends circumferentially, and the engagement projection has a downward projecting part and a radially outward projecting part projecting from the downward projecting part; and an annular engagement groove, with which the engagement projection is detachably engaged, is formed at an upper portion of the lid. Due to the above structure, the contact-preventing member can be easily installed on the upper portion of the lid, and unexpected disengagement of the contact-preventing member from the upper portion of the lid can be prevented. In addition, the contact-preventing member can be easily removed from the lid by compressing the contact-preventing member to be in a reduced diameter and then by raising the contact-preventing member by hand work. Thus, the contact-preventing member can be easily replaced with a new one, resulting in improved maintainability.

Preferably, a disengagement-preventing member is attached to an outer side of the lid, and the disengagement-preventing member engages with an engagement groove formed in an outer side of the contact-preventing member to prevent the contact-preventing member from being removed from the lid. Thereby, unexpected disengagement of the contact-preventing member from the upper section of the lid due to any external force can be prevented with further certainty.

Preferably, the contact-preventing member has an annular shape and has a cutout to absorb circumferential thermal expansion of the contact-preventing member; a stepped portion is formed on a peripheral portion of the lid outside the sealing member, the contact-preventing member engages with the stepped portion, an upward-disengagement preventing structure for preventing upward movement of the contact-preventing member is provided on an outer circumferential surface of the stepped portion and on an inner circumferential surface of the contact-preventing member; and a plurality of expansion-preventing members are provided on an outer circumferential surface of the lid at intervals to suppress outward expansion of the contact-preventing member. Thereby, the contact-preventing member is formed into a simple shape avoiding stress concentration, and a wide pressure-bearing area of the contact-preventing member is ensured.

DETAILED DESCRIPTION OF THE PREFERRED EMBODIMENTS

Figure 1:
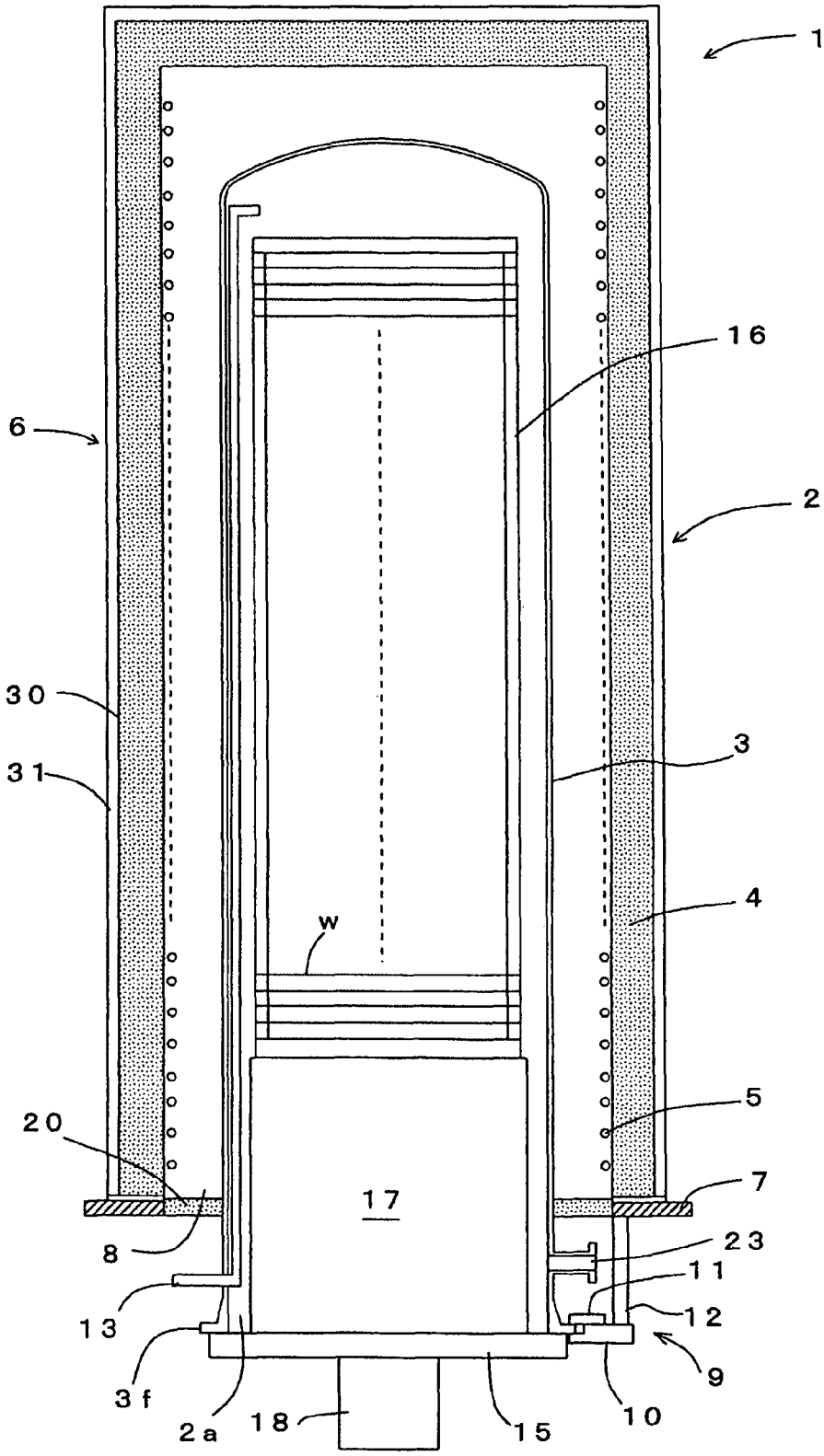
FIG. 1 is a vertical cross-sectional view schematically showing a heat treatment apparatus in a first embodiment of the present invention.
Figure 2:
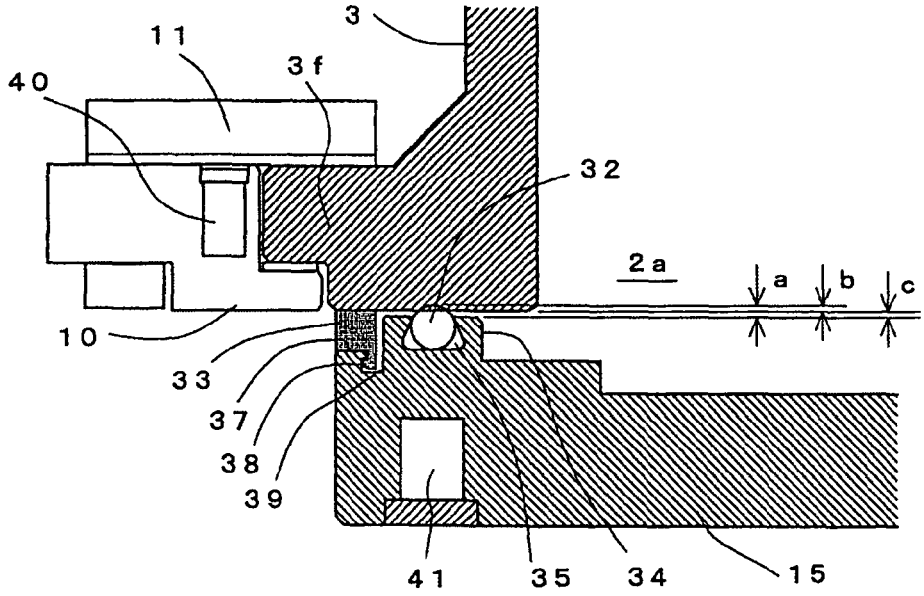
FIG. 2 is an enlarged cross-sectional view showing main parts of the heat treatment apparatus.
Figure 3:
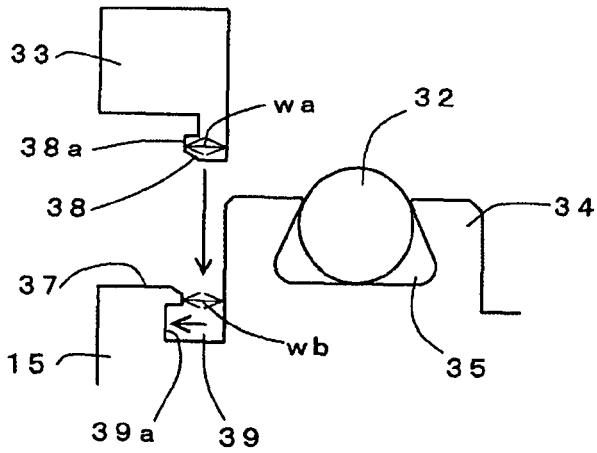
FIG. 3 is a diagram explaining a structure for mounting a contact-preventing member on a lid.
Figure 4:
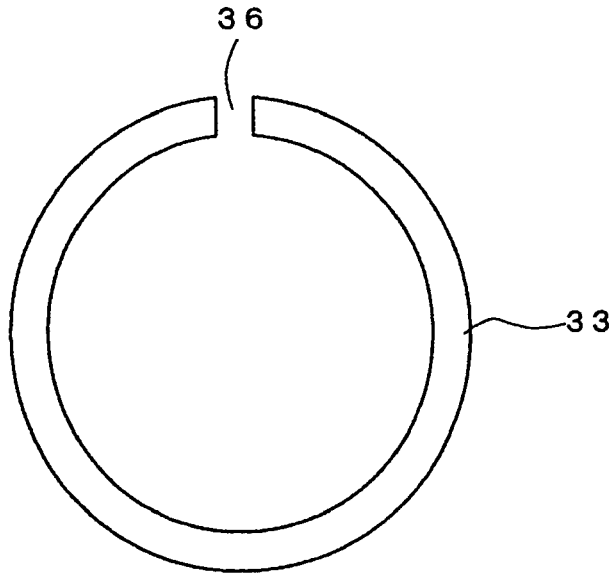
FIG. 4 is a plan view of the contact-preventing member.

Preferred embodiments of the present invention will be described in detail with reference to the accompanying drawings. FIG. 1 is a vertical cross-sectional view schematically showing a heat treatment apparatus in a first embodiment of the present invention. FIG. 2 is an enlarged cross-sectional view showing a main portion of the heat treatment apparatus. FIG. 3 is a diagram explaining a structure for mounting a contact-preventing member on a lid. FIG. 4 is a plan view of the contact-preventing member.

Referring to FIG. 1, reference number 1 denotes a vertical heat treatment apparatus that is one type of semiconductor manufacturing apparatus. The heat treatment apparatus 1 has a vertical heat treatment furnace 2, which is adapted to accommodate simultaneously a large number of process objects, such as semiconductor wafers W, so as to perform a heat treatment (thermal process) such as low-pressure diffusion process to those wafers. The heat treatment furnace 2 primarily includes: a processing vessel (a vessel main body) 3 that accommodates the wafers W at multiple levels to perform a predetermined heat treatment to the wafers W; a tubular heat insulator 4 surrounding the processing vessel 3; and resistance heating elements (also referred to as "heating wires") 5 disposed in a helical or meandering manner along the inner surface of the heat insulator 4. The upper end of the tubular heat insulator 4 is closed. The heat insulator 4 and the resistance heating elements 5 constitute a heater 6.

The heat treatment apparatus 1 has a base plate 7 for installing the heater 6. An opening 8 is formed in the base plate 7 for inserting the processing vessel 3 upward from below the base plate 7. A heat insulator 20 is provided in the opening 8 to close the gap between the base plate 7 and the processing vessel 3.

The processing vessel 3 is also called a process tube (reaction tube). The processing vessel 3 is made of quartz and is formed into a vertically elongated cylindrical shape whose upper end is closed and whose lower end is opened. An outward extending flange **3*f* is formed at the open end of the processing vessel 3. The flange 3*f* is supported by the base plate 7 via a flange support member 9. As shown in FIG. 2, the flange supporting member 9 includes an annular support frame 10 supporting a lower peripheral portion of the flange 3*f*, a flange retainer 11 mounted on the support frame 10 by means of a screw or the like to hold an upper portion of the flange 3*f*, and a plurality of support rods 12 each supporting outer peripheral parts of the support frame 10 from the base plate 7**.

The processing vessel 3 in the illustrate embodiment is provided, at a lower portion thereof, with an introduction port 13 for introducing a process gas, an inert gas, and the like into the processing vessel 3, and an exhaust port 23 for exhausting gases in the processing vessel 3. A gas supply source is connected to the introduction port 13. Connected to the exhaust port 23 is an exhaust system with a vacuum pump, which is controlling the internal pressure of the processing vessel 3 to a reduced pressure at a level of, for example, about 10 to $10^{-8}$ Torr.

A lid 15 is disposed below the processing vessel 3 to open and close a furnace throat **2*a* which is a lower end opening of the processing vessel 3. The lid 15 moves vertically by means of an elevating mechanism (not shown). A boat 16, which is a wafer holder for holding therein a large number of (e.g., about 100 to 150 pcs.) wafers having a diameter of, for example, 300 mm at regular vertical intervals, is mounted on the lid 15 via a heat insulating tube 17 for preventing heat dissipation through the furnace throat. The lid 15 is provided with a rotating mechanism 18 that rotates the boat 16 about its center axial. The lid 15 moves downward to unload the boat 16 from the inside of the processing vessel 3 into a loading area provided below the processing vessel 3, and after transferring of the wafers W, moves upward to load the boat 16 into the processing vessel 3**.

In order to maintain the shape of the heat insulator 4 and to reinforce the same, the outer surface of the heat insulator 4 is covered with an outer shell 30 of a metal, for example, a stainless steel, as shown in FIG. 1. In addition, the outer surface of the outer shell 30 is covered with a water-cooled jacket 31 to suppress thermal effects on the exterior of the heater.

As shown in FIG. 2, an O-ring 32 which is an annular sealing member is disposed on an upper peripheral portion of the lid 15. The O-ring 32 seals the gap between the lid and the throat 2*a* of the processing vessel 3 (more specifically, the throat flange 3*f*). In addition, a contact-preventing member 33 made of a heat-resistant resin is disposed on the upper peripheral portion of the lid 15. The contact-preventing member 33 is disposed radially outside the O-ring 32. The contact-preventing member 33 prevents contact between the lid 15 and the throat flange 3*f* due to squashing of the O-ring 32 between the lid 15 and the throat flange 3*f* which would otherwise occur when the internal pressure of the processing vessel 3 is reduced. The lid 15 is made of a metal, for example, a stainless steel. The O-ring 32 is made of a heat-resistant resin, for example, a fluorinated resin. A mounting protrusion 34 for mounting the O-ring 32 which has an annular shape in plan view is formed on the upper peripheral portion of the lid 15 to mount the O-ring 32 to the lid 15. The O-ring 32 is fitted into an annular groove 35 formed in the upper face of the mounting protrusion 34. The O-ring 32 has a diameter of, for example, 400 mm; and a sectional diameter of, for example, 5.7 mm. The O-ring 32 protrudes by a predetermined height "a" of 1.1 mm from the upper face of the mounting protrusion 34.

As shown in FIG. 4, the contact-preventing member 33 has an annular shape in plan view and has a cutout 36 to absorb the circumferential thermal expansion of the contact-preventing member 33 and/or the lid 15. Preferably, the contact-preventing member 33 has a square or rectangular cross section. A bearing surface 37, on which the contact-preventing member 33 is placed, is formed in the peripheral portion of the upper face of the lid 15.

In order to detachably mount the contact-preventing member 33 to the lid 15 such that the contact-preventing member 33 can readily be mounted to the lid but unexpected removal of the contact-preventing member 33 from the lid 15 can be prevented, an engagement projection 38 having a substantially L-shaped cross section and extending circumferentially is formed on a lower portion of the contact-preventing member 33, and an engagement groove 39 having substantially L-shaped cross section and having an annular shape in plan view is formed in an upper portion of the lid 15. The engagement projection 38 detachably engages with the engagement groove 39. The engagement projection 38 has a vertically extending portion and a radially outward extending portion 38*a*. The width "wa" (see FIG. 2) of the engagement projection 38 at a distal end thereof, and the width "wd" (see FIG. 2) of the engagement groove 39 at the entrance thereof are substantially the same, so that the engagement projection 38 can easily be inserted into the engagement groove 39. The contact-preventing member 33 is compressed to be in a slightly smaller diameter and then the engagement projection 38 is inserted into the engagement groove 39. Thereafter, the compressing force exerted on the contact-preventing member 33 is released, the diameter of the engagement projection 38 is increased due to its own resilient restoration force, and the outward extending portion 38*a* at the distal end of the engagement projection 38 tightly engages with an outward oriented groove 39*a*. Thus, unexpected removal of the contact-preventing member 33 from the lid can be prevented.

The heat treatment apparatus 1 is designed such that: in a case where the internal pressure of the processing vessel 3 is equal to the atmospheric pressure, when the furnace throat 3 of the processing vessel 3 is closed by the lid 15, the amount of squeeze (squashing) of the O-ring 32 is 0.4 mm, the clearance between the upper face of the mounting protrusion 34 and the lower face of the throat flange 3*f* is 0.7 mm, and the clearance between the upper face of the contact-preventing member 33 and the lower face of the throat flange 3*f* is 0.4 mm; and in a case where the pressure of the processing vessel 3 is reduced, when the furnace throat 3 of the processing vessel 3 is closed by the lid 15, the amount of squeeze "b" of the O-ring 32 is 0.8 mm, and the clearance "c" between the upper face of the mounting protrusion 34 and the lower face of the throat flange 3*f* is 0.3 mm, as shown in FIG. 2.

When the internal pressure of the processing vessel 3 is reduced, the atmospheric pressure exerted on the surface of the lid 15 inside the O-ring 32 is about 1.3 tons, for example. Accordingly, the contact-preventing member must withstand a compressive load up to about 10-20 kg/cm$^2$, preferably, about 16 kg/cm$^2$. In addition, the contact-preventing member must withstand temperatures up to about 250° C. It is also necessary for the contact-preventing member 33 to be elastic enough to absorb any irregularity which may present on the lower face of the throat flange 3*f* made of quartz. Polyimide, which is excellent in elasticity, heat resistance and withstand load, is a suitable resin material that satisfies the above requirements of the contact-preventing member 33.

As shown in FIG. 2, in order to prevent the O-ring 32 from being overheated, the support frame 10 has a cooling water channel 40 that circulates cooling water and indirectly cools the flange 3*f* of the processing vessel 3, and the lid 15 also has a cooling water channel 41 for cooling the O-ring 32.

As described above, the heat treatment apparatus 1 includes: the processing vessel 3 made of quartz and having the throat flange 3*f* at its lower portion and capable of performing a predetermined heat treatment to the internally accommodated wafers under reduced pressure; the metallic lid 15 on which the boat 16 holding many wafers mounted thereon is placed, the lid 15 being adapted to load and unload the boat 16 into and from the processing vessel 3 and to close and open the throat flange 3*f*; and the annular O-ring 32 provided on the peripheral portion of the lid 15 seal the gap between the lid 15 and the throat flange 3*f* of the processing vessel 3. In addition, the heat treatment apparatus is further provided, on the peripheral portion of the lid 15, with the contact-preventing member 33 made of a heat-resistant resin that prevents contact between the lid 15 and the throat flange 3*f* due to squashing (excessive squeezing) of the O-ring 32 between the lid 15 and the throat flange 3*f* which would otherwise occur when the internal pressure of the process chamber is reduced. These structural characteristics of the apparatus 1 make it possible to prevent damage (such as cracks, breakage, and nicks) of the throat flange 3*f* due to direct contact between the lid 15 and the throat flange 3*f* resulted from the squashing (excessive squeezing) of the O-ring 32 between the lid 15 and the throat flange 3*f* when the internal pressure of the processing vessel 3 is reduced, and achieves a longer working life of the processing vessel 3. The generation of particles due to formation of micro cracks in the processing vessel 3 can also be prevented.

Since the contact-preventing member 33 has an annular shape, compressive load, which is applied to the contact-preventing member 33 when the processing vessel 3 is evacuated, distributes circumferentially over the contact-preventing member 33, and thus the contact-preventing member 33 well withstands the compressive load. In addition, since the contact-preventing member 33 has the cutout 36, the circumferential thermal expansion is well absorbed. Thereby, a longer working life of the contact-preventing member 33 and the processing vessel 3 can be achieved.

In addition, since the lower portion of the contact-preventing member 33 has the circumferentially-extending engagement projection 38 having the downward projecting portion and the radially outward projecting portion 38*a*, and since the upper portion of the lid 15 has the annular engagement groove 39 with which the engagement projection 38 detachably engages, the contact-preventing member 33 can be easily installed on the upper portion of the lid 15 and unexpected disengagement of the contact-preventing member 33 from the upper portion of the lid 15 can be prevented. Furthermore, the diameter-reducing operation to the contact-preventing member 33 and subsequent lifting operation to the contact-preventing member 33 by hand work allows the contact-preventing member 33 to be easily removed. The contact-preventing member 33 can be easily replaced with another one, improving the maintainability.

Figure 5:
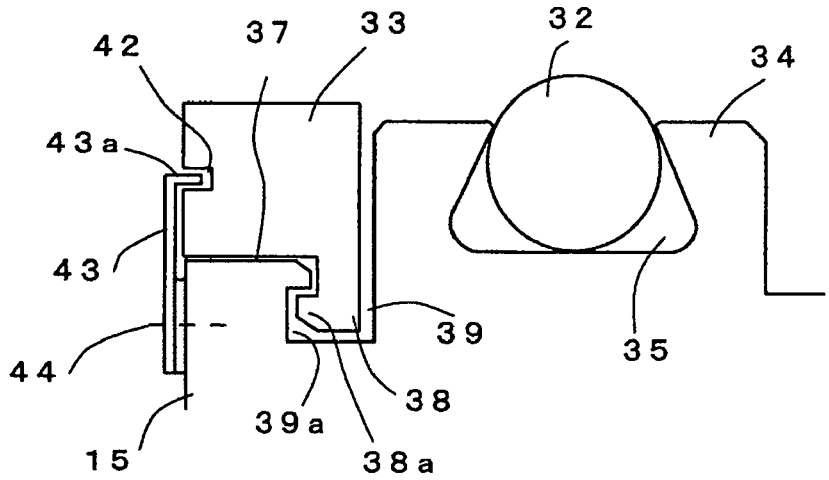
FIG. 5 is a schematic cross-sectional view showing one modification of the mounting structure of the contact-preventing member.

FIG. 5 is a schematic cross-sectional view showing one modification of the mounting structure for the contact-preventing member. In FIG. 5, substantially the same elements as those shown in FIGS. 2 and 3 are assigned the same reference numbers and duplicative description is omitted. With the structure of FIG. 5, in order to more reliably prevent unexpected disengagement of the contact-preventing member 33 from the upper portion of the lid 15 due to any external force, a disengagement-preventing members 43 for preventing the disengagement or come-off of the contact-preventing member 33 are removably attached to the outer surface of the lid 15 via screws 44 or the like. The disengagement-preventing members 43 engage with an engagement groove 42 formed in the outer side of the contact-preventing member 33.

The engagement groove 42 is formed in the outer side of the contact-preventing member 33 such that it extends continuously over the whole circumference, or such that it is divided into plural segments arranged circumferentially at angular intervals. Each of the disengagement-preventing members 43 is formed into an L-shaped cross section, and has a proximal end fixed to a lateral face (outer side) of the lid 15 by a screw 44 and a distal end (engagement portion 43*a*) inserted within the engagement groove 42. The disengagement-preventing members 43 are attached to the lateral face (outer side) of the lid 15 at angular intervals. With the structure of FIG. 5, the disengagement or come-off of the contact-preventing member 33 can be prevented with further certainty, since the disengagement-preventing members 43 for preventing the disengagement of the contact-preventing member 33 by engaging with the engagement groove 42 formed in the outer side of the contact-preventing member 33 is mounted on the outer surface of the lid 15.

Figure 6:
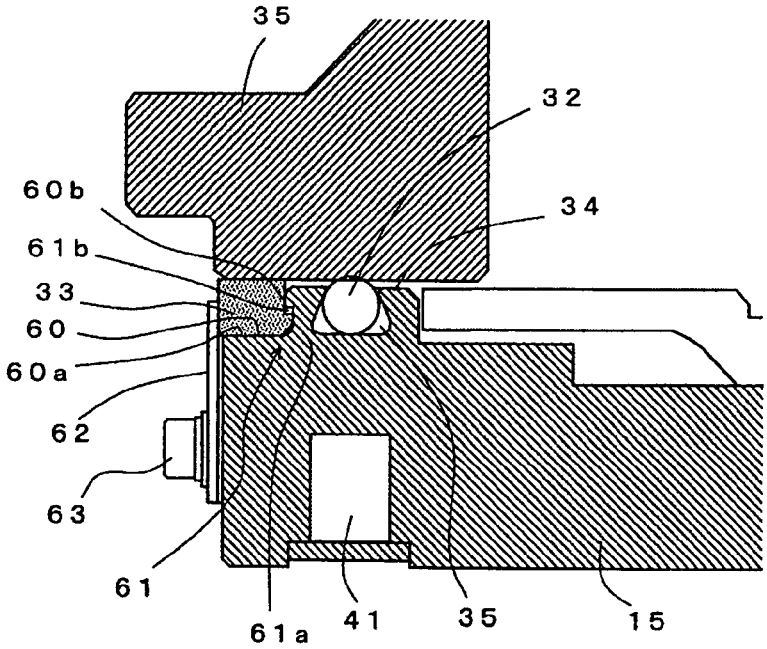
FIG. 6 is a sectional view showing another modification of the mounting structure for the contact-preventing member.
Figure 7:
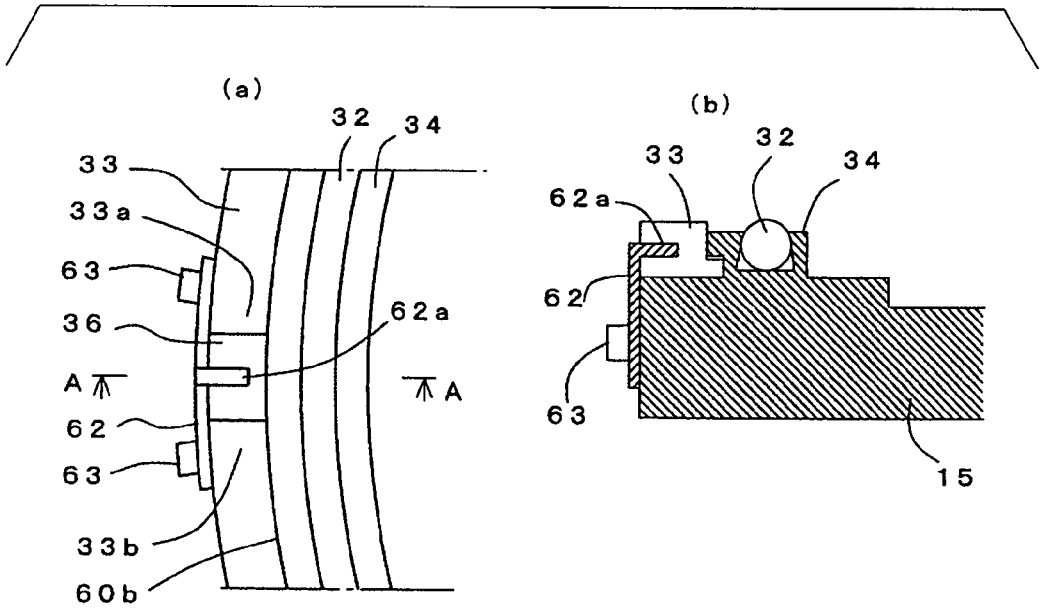
FIG. 7 is a plan view schematically showing an upper face of the lid.

FIG. 6 is a cross-sectional view showing another modification of the mounting structure for the contact-preventing member. FIG. 7 is a plan view schematically showing the upper face part of the lid. The lid 15 in this modification has, on a peripheral portion thereof outside the O-ring 32, a stepped portion 60 with which the contact-preventing member 33 engages. Additionally, there is provided a disengagement-preventing structure 61, for preventing upward movement (disengagement) of the contact-preventing member 33, which comprises engagement portions respectively formed on an outer surface 60*b* of the stepped portion 60 and on an inner surface of the contact-preventing member 33 for mutual engagement. Furthermore, a plurality of (e.g., two to four) expansion-preventing members 62 each for preventing outward expansion of the contact-preventing member 33 are arranged at appropriate or regular intervals in a circumferential direction on the outer surface of the lid 15.

The stepped portion 60 includes a horizontal upper face 60*a* and a vertical outer surface 60*b*. As shown in FIG. 4, the contact-preventing member 33 includes the cutout 36 formed into an annular shape in plan view to absorb circumferential thermal expansion. The contact-preventing member 33 is also formed to have a rectangular cross section as shown in FIG. 6. The lower face of the contact-preventing member 33 rests on the upper face 60*a* of the stepped portion 60, the inner face the contact-preventing member 33 opposes to the outer surface 60*b* of the stepped portion 60. The upper face of the contact-preventing member 33 is located at a level higher than that of the upper face of the mounting protrusion 34 by a predetermined height of, for example, 0.3 mm.

The disengagement-preventing structure 61 preferably comprises a circumferentially-extending projection 61*a* formed on the lower portion of the inner circumferential surface of the contact-preventing member 33, and a circumferentially-extending recess 61*b* formed in the lower portion of the outer surface 60*b* of the stepped portion 60 which is the outer circumferential surface of the mounting protrusion 34. The positional relationship between the projection 61*a* and the recess 61*b* may be reversed. That is to say, the projection may be formed on the outer surface of the stepped portion 60, and the recess in the inner surface of the contact-preventing member 33. The vertical width of the recess 61*b* may be slightly greater than that of the projection 61*a* so that a slight vertical movement of the contact-preventing member 33 is allowed. The expansion-preventing members 62 are made of a metallic plate and formed, for example, to have a curved surface having a predetermined length (e.g., 20 mm) along the outer surface of the lid 15. The expansion-preventing members 62 are each fixedly mounted on the outer surface of the lid 15 via at least one pair of right and left fixing screws 63. As shown in FIG. 7, one of the expansion-preventing members 62 is preferably disposed so as to bridge the gap (i.e., the cutout 36) between the free ends 33*a* and 33*b* of the contact-preventing member 33, whereby radial outward expansion of the free ends 33*a* and 33*b* can be prevented more effectively. In addition, preferably, a circumferential positioning protrusion 62*a* is provided on the aforementioned one expansion-preventing member 62. The circumferential positioning protrusion 62*a* is inserted into the cutout 36 between the free ends 33*a* and 33*b* of the contact-preventing member 33 while leaving gaps between the circumferential positioning protrusion 62*a* and the free ends 33*a* and 33*b*. The circumferential positioning protrusion 62*a* prevents such an amount of rotation the contact-preventing member 33 that one of the free ends 33*a* and 33*b* is removed from the expansion-preventing member 62, but allows a limited amount of rotation of the contact-preventing member 33. Thus, thermal expansion of the contact-preventing member 33 can still be absorbed due to provision of the gaps between the circumferential positioning protrusion 62*a* and the free ends 33*a* and 33*b*.

In the modification of FIG. 7, the stepped portion 60 is formed on the peripheral portion of the lid 15 outside the O-ring 32, the contact-preventing member 33 engages with the stepped portion 60, the upward-disengagement preventing structure 61 for preventing upward movement of the contact-preventing member 61 is provided on the outer circumferential surface 60*b* of the stepped portion 60 and on the inner circumferential surface of the contact-preventing member 33, and a plurality of expansion-preventing members 62 are provided on the outer circumferential surface of the lid 15 at intervals to prevent outward expansion of the contact-preventing member 33. Thus, the contact-preventing member 33 may be formed into a simple shape avoiding stress concentration, and a wide pressure-bearing area of the contact-preventing member 33 is ensured, achieving a longer working life of the contact-preventing member 33.

Figure 8:
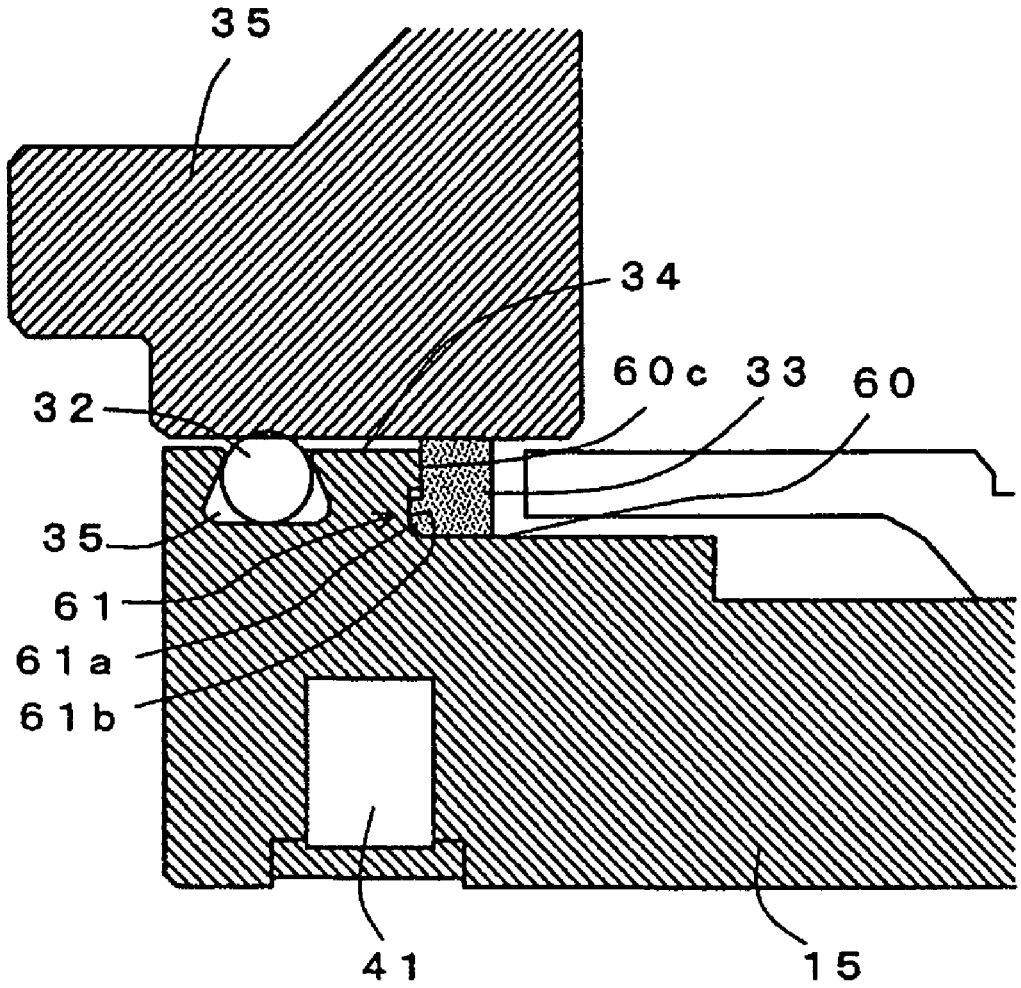
FIG. 8 is a cross-sectional view showing another modification of the mounting structure for the contact-preventing member.

FIG. 8 is a sectional view showing yet another modification of the mounting structure for the contact-preventing member. In this modification, substantially the same elements as those shown in FIG. 6 are assigned the same reference numbers and duplicative description is omitted. The lid 15 in this modification has, on a peripheral portion thereof inside the O-ring 32, a stepped portion 60 with which the contact-preventing member 33 engages. Additionally, there is provided a disengagement-preventing structure 61, for preventing upward movement (disengagement) of the contact-preventing member 33, which comprises engagement portions respectively formed on an inner surface 60*c* of the stepped portion 60 and on an inner surface of the contact-preventing member 33 for mutual engagement. The disengagement-preventing structure 61 preferably comprises a circumferentially-extending projection 61*a* formed on the lower portion of the outer circumferential surface of the contact-preventing member 33, and a circumferentially-extending recess 61*b* formed in the lower portion of the inner circumferential surface 60*c* of the stepped portion 60. The positional relationship between the projection 61*a* and the recess 61*b* may be reversed. In this modification, substantially the same advantageous effects as those of the modification in FIG. 6 can also be achieved. No expansion-preventing members are required since the inner surface 60*c* of the stepped portion 60 prevents expansion of the contact-preventing member 33.

Figure 9:
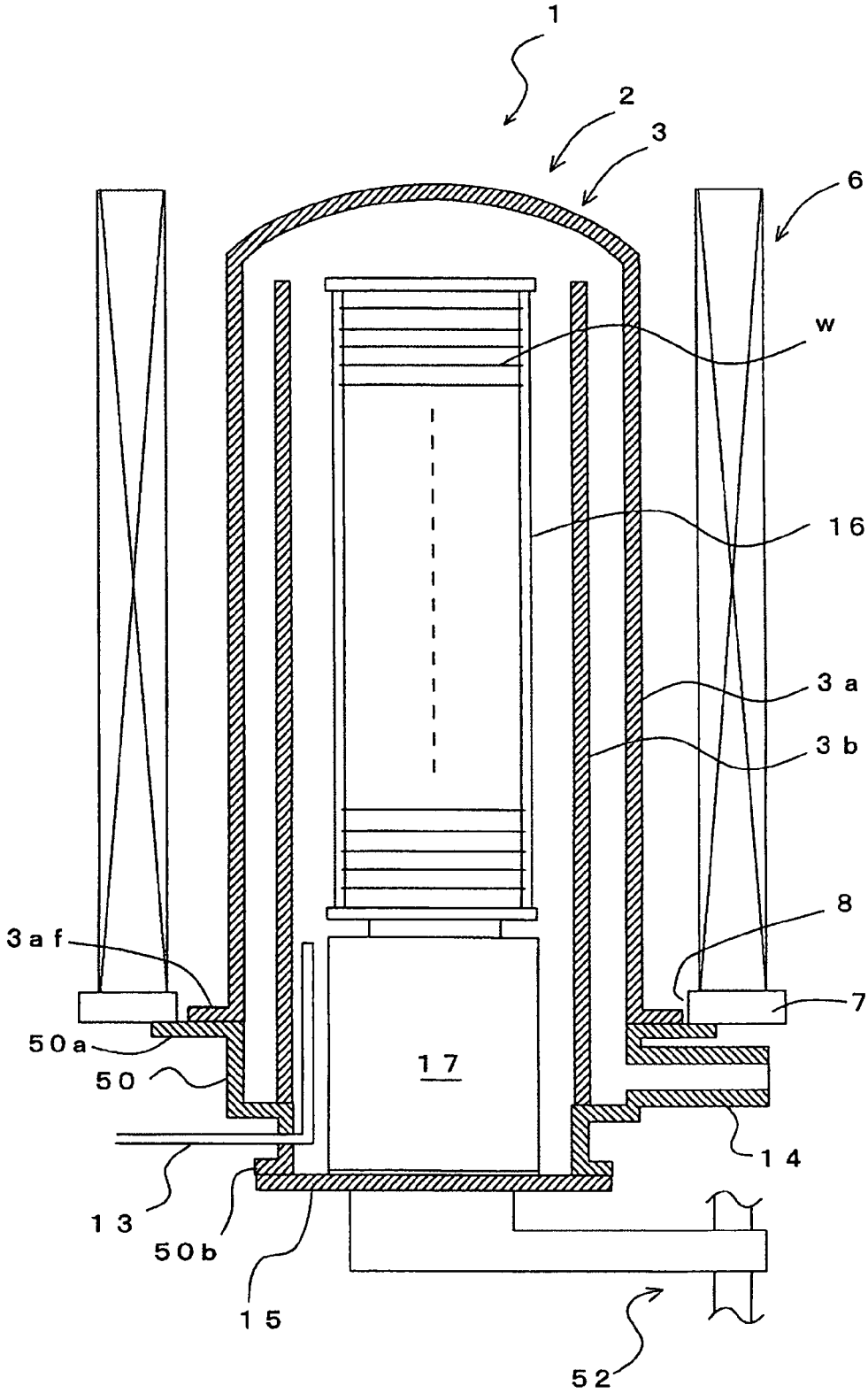
FIG. 9 is a vertical cross-sectional view schematically showing a heat treatment apparatus in a second embodiment of the present invention.
Figure 10:
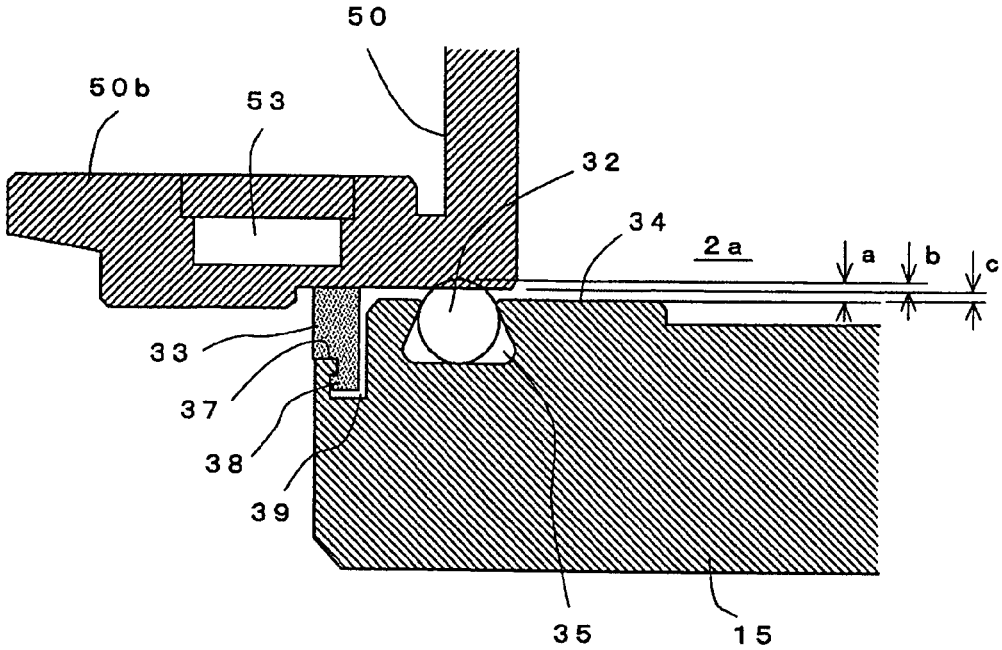
FIG. 10 is an enlarged cross-sectional view showing main parts of the heat treatment apparatus.

FIG. 9 is a vertical cross-sectional view schematically showing a heat treatment apparatus in a second embodiment of the present invention. FIG. 10 is an enlarged cross-sectional view showing main parts of the heat treatment apparatus. In FIG. 9, reference number 1 denotes a vertical heat treatment apparatus that is one type of semiconductor manufacturing apparatus. The heat treatment apparatus 1 has a vertical heat treatment furnace 2, which is adapted to accommodate simultaneously a large number of process objects, such as semiconductor wafers W, so as to perform a heat treatment (thermal process) such as low-pressure diffusion process to those wafers. The heat treatment furnace 2 primarily includes: a processing vessel (a vessel main body) 3 that accommodates the wafers W at multiple levels to perform a predetermined heat treatment to the wafers W; and a heater 6 surrounding the processing vessel 3 to heat the wafers W.

The heat treatment apparatus 1 has a base plate 7 for installing the heater 6. An opening 8 is formed in the base plate 7 for inserting the processing vessel 3 upward from below the base plate 7.

The processing vessel 3 is also called a process tube (reaction tube), which is made of quartz and is of a double-tube structure including a vertically-elongated cylindrical outer tube 3*a* whose upper end is opened and whose lower end is closed and a vertically-elongated cylindrical inner tube 3*b* disposed inside the outer tube 3*a*. An outward extending flange 3*af* is formed at the open end of the outer tube 3*a*. The flange 3*af* is airtightly connected to an upper end flange 50*a* of a short cylindrical manifold 50 made of a stainless steel which is a metallic furnace throat member. The manifold 50 is fixed to a lower portion of the base plate 7. Note that, in the second embodiment, a processing vessel may be deemed be composed of a vessel main body comprising a quartz process tube and a metallic manifold connected to the vessel main body. In this case, the lower end opening serves as a furnace throat. Also note that, in the previously-described first embodiment, the processing vessel may be deemed to consist essentially of a vessel main body comprising a quartz process tube. In this case, the lower end opening of the process tube serves as a furnace throat.

In the interior of the manifold 50, the lower end of the inner tube 3*b* rests on manifold 50 to be supported by the manifold 50. The manifold 50 is provided, at a side thereof, with an introduction port 13 for introducing a process gas, an inert gas, and the like into the inside of the inner tube 3*b* of the processing vessel 3, and an exhaust port 23 for exhausting gases in the processing vessel 3 from the space between the outer tube 3*a* and inner tube 3*b*. A gas supply source is connected to the introduction port 13. Connected to the exhaust port 23 is an exhaust system with a vacuum pump, which is controlling the internal pressure of the processing vessel 3 to a reduced pressure at a level of, for example, about 10 to $10^{-8}$ Torr.

A lid 15 is disposed below the manifold 50 to open and close a furnace throat 2*a* which is a lower end opening of the manifold 50. The lid 15 moves vertically by means of an elevating mechanism (not shown). A boat 16, which is a wafer holder for holding therein a large number of (e.g., about 100 to 150 pcs.) wafers having a diameter of, for example, 300 mm at regular vertical intervals, is mounted on the lid 15 via a heat insulating tube 17 for preventing heat dissipation through the furnace throat. The lid 15 is provided with a rotating mechanism 18 that rotates the boat 16 about its center axial. The lid 15 moves downward to unload the boat 16 from the inside of the processing vessel 3 into a loading area provided below the processing vessel 3, and after transferring of the wafers W, moves upward to load the boat 16 into the processing vessel 3.

As shown in FIG. 10, an O-ring 32 which is an annular sealing member is disposed on an upper peripheral portion of the lid 15. The O-ring 32 seals the gap between the lid 15 and the manifold 50. In addition, a contact-preventing member 33 made of a heat-resistant resin is disposed on the upper peripheral portion of the lid 15. The contact-preventing member 33 is disposed radially outside the O-ring 32. The contact-preventing member 33 prevents contact between the lid 15 and the manifold 50 due to squashing of the O-ring 32 between the lid 15 and the manifold 50 which would otherwise occur when the internal pressure of the processing vessel 3 is reduced. An outward extending flange 50*b* is formed at the lower end opening the manifold 50. The upper peripheral portion of the lid 15 is pressed against the flange 50*b* via the O-ring 32 to hermetically close the processing vessel 3. A cooling water channel 53 is formed in the flange 50*b* to cool the flange 50*b* in order to prevent overheating of the O-ring 32.

The lid 15 is made of a metal, for example, a stainless steel. The O-ring 32 is made of a heat-resistant resin, for example, a fluorinated resin. A mounting protrusion 34 for mounting the O-ring 32 which has an annular shape in plan view is formed on the upper peripheral portion of the lid 15 to mount the O-ring 32 to the lid 15. The O-ring 32 is fitted into an annular groove 35 formed in the upper face of the mounting protrusion 34. The O-ring 32 has a diameter of, for example, 430 mm; and a sectional diameter of, for example, 5.7 mm. The O-ring 32 protrudes by a predetermined height "a" of 1.1 mm from the upper face of the mounting protrusion 34.

As previously described with reference to FIG. 4 in connection with the first embodiment, the contact-preventing member 33 has an annular shape in plan view and has a cutout 36 to absorb the circumferential thermal expansion of the contact-preventing member 33 and/or the lid 15. Preferably, the contact-preventing member 33 has a square or rectangular cross section. A bearing surface 37, on which the contact-preventing member 33 is placed, is formed in the peripheral portion of the upper face of the lid 15, as shown in FIG. 10.

In order to detachably mount the contact-preventing member 33 to the lid 15 such that the contact-preventing member 33 can readily be mounted to the lid but unexpected removal of the contact-preventing member 33 from the lid 15 can be prevented, an engagement projection 38 having a substantially L-shaped cross section and extending circumferentially is formed on a lower portion of the contact-preventing member 33, and an engagement groove 39 having substantially L-shaped cross section and having an annular shape in plan view is formed in an upper portion of the lid 15. The engagement projection 38 detachably engages with the engagement groove 39. The engagement projection 38 has a vertically extending portion and a radially outward extending portion 38*a*. The width "wa" (see FIG. 2) of the engagement projection 38 at a distal end thereof, and the width "wd" (see FIG. 2) of the engagement groove 39 at the entrance thereof are substantially the same, so that the engagement projection 38 can easily be inserted into the engagement groove 39. The contact-preventing member 33 is compressed to be in a slightly smaller diameter and then the engagement projection 38 is inserted into the engagement groove 39. Thereafter, the compressing force exerted on the contact-preventing member 33 is released, the diameter of the engagement projection 38 is increased due to its own resilient restoration force, and the outward extending portion 38*a* at the distal end of the engagement projection 38 tightly engages with an outward oriented groove 39*a*. Thus, unexpected removal of the contact-preventing member 33 from the lid can be prevented.

The heat treatment apparatus 1 is designed such that: in a case where the internal pressure of the processing vessel 3 is equal to the atmospheric pressure, when the manifold 50 is closed by the lid 15, the amount of squeeze (squashing) of the O-ring 32 is 0.4 mm, the clearance between the upper face of the mounting protrusion 34 and the lower face of the manifold 50 is 0.7 mm, and the clearance between the upper face of the contact-preventing member 33 and the lower face of the manifold 50 is 0.4 mm; and in a case where the pressure of the processing vessel 3 is reduced, when the manifold 50 is closed by the lid 15, the amount of squeeze "b" of the O-ring 32 is 0.8 mm, and the clearance "c" between the upper face of the mounting protrusion 34 and the lower face of the manifold 50 is 0.3 mm, as shown in FIG. 10.

When the internal pressure of the processing vessel 3 is reduced, the atmospheric pressure exerted on the surface of the lid 15 inside the O-ring 32 is about 1.5 tons, for example. Accordingly, the contact-preventing member must withstand a compressive load up to about 10-20 kg/cm$^2$, preferably, about 16 kg/cm$^2$. In addition, the contact-preventing member must withstand temperatures up to about 250° C. It is also necessary for the contact-preventing member 33 to be softer than the metal (e.g., stainless steel) forming the manifold 50 in order to avoid damaging the lower face of the manifold 50. Polyimide, which is excellent in elasticity, heat resistance and withstand load, is a suitable resin material that satisfies the above requirements of the contact-preventing member 33.

As described above, the heat treatment apparatus 1 includes: the processing vessel 3 made of quartz and capable of performing a predetermined heat treatment to the internally accommodated wafers under reduced pressure; the metallic manifold 50 connected to the lower portion of the processing vessel 3 to provide the furnace throat 2*a*; the metallic lid 15 on which the boat 16 holding many wafers mounted thereon is placed, the lid 15 being adapted to load and unload the boat 16 into and from the processing vessel 3 and to close and open the furnace throat 2*a*; and the annular O-ring 32 provided on the peripheral portion of the lid 15 seal the gap between the lid 15 and the manifold 50. In addition, the heat treatment apparatus is further provided, on the peripheral portion of the lid 15, with the contact-preventing member 33 made of a heat-resistant resin that prevents contact between the lid 15 and the manifold 50 due to squashing (excessive squeezing) of the O-ring 32 between the lid 15 and the manifold 50 which would otherwise occur when the internal pressure of the process chamber is reduced. These structural characteristics of the apparatus 1 make it possible to prevent chafing between the lid 15 and the manifold 50 due to direct contact between the lid 15 and the manifold 50 resulted from the squashing (excessive squeezing) of the O-ring 32 between the lid 15 and the manifold 50 when the internal pressure of the processing vessel 3 is reduced. Thus, metallic contamination of the wafers W due to the chafing can be prevented.

Since the contact-preventing member 33 has an annular shape, compressive load, which is applied to the contact-preventing member 33 when the processing vessel 3 is evacuated, distributes circumferentially over the contact-preventing member 33, and thus the contact-preventing member 33 well withstands the compressive load. In addition, since the contact-preventing member 33 has the cutout 36, the circumferential thermal expansion is well absorbed. Thereby, a longer working life of the contact-preventing member 33 and the processing vessel 3 can be achieved.

In addition, since the lower portion of the contact-preventing member 33 has the circumferentially-extending engagement projection 38 having the downward projecting portion and the radially outward projecting portion 38*a*, and since the upper portion of the lid 15 has the annular engagement groove 39 with which the engagement projection 38 detachably engages, the contact-preventing member 33 can be easily installed on the upper portion of the lid 15 and unexpected disengagement of the contact-preventing member 33 from the upper portion of the lid 15 can be prevented. Furthermore, the diameter-reducing operation to the contact-preventing member 33 and subsequent lifting operation to the contact-preventing member 33 by hand work allows the contact-preventing member 33 to be easily removed. The contact-preventing member 33 can be easily replaced with another one, improving the maintainability.

As previously described with reference to FIG. 5 in connection with the first embodiment, in order to more reliably prevent unexpected disengagement of the contact-preventing member 33 from the upper portion of the lid 15 due to any external force, it is preferable that a disengagement-preventing members 43 for preventing the disengagement or come-off of the contact-preventing member 33 are removably attached to the outer surface of the lid 15 via screws 44 or the like. The disengagement-preventing members 43 engage with an engagement groove 42 formed in the outer side of the contact-preventing member 33.

Figure 11:
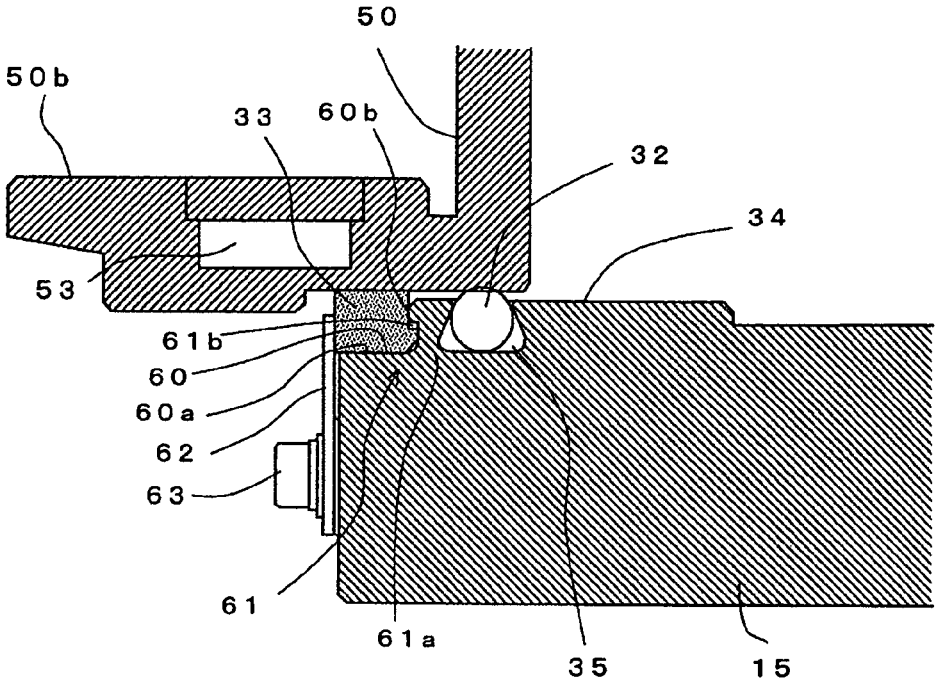
FIG. 11 is a cross-sectional view showing yet another modification of the mounting structure for the contact-preventing member.

FIG. 11 is a cross-sectional view showing yet another modification of the mounting structure for the contact-preventing member. In this modification, the lid 15 has, on a peripheral portion thereof outside the O-ring 32, a stepped portion 60 with which the contact-preventing member 33 engages. Additionally, there is provided a disengagement-preventing structure 61, for preventing upward movement (disengagement) of the contact-preventing member 33, which comprises engagement portions respectively formed on an outer surface 60*b* of the stepped portion 60 and on an inner surface of the contact-preventing member 33 for mutual engagement. Furthermore, a plurality of (e.g., two to four) expansion-preventing members 62 each for preventing outward expansion of the contact-preventing member 33 are arranged at appropriate or regular intervals in a circumferential direction on the outer surface of the lid 15.

The stepped portion 60 includes a horizontal upper face 60*a* and a vertical outer surface 60*b*. As previously described with reference to FIG. 4 in connection with the first embodiment, the contact-preventing member 33 includes the cutout 36 formed into an annular shape in plan view to absorb circumferential thermal expansion. The contact-preventing member 33 is also formed to have a rectangular cross section as shown in FIG. 6. The lower face of the contact-preventing member 33 rests on the upper face 60*a* of the stepped portion 60, the inner face the contact-preventing member 33 opposes to the outer surface 60*b* of the stepped portion 60. The upper face of the contact-preventing member 33 is located at a level higher than that of the upper face of the mounting protrusion 34 by a predetermined height of, for example, 0.3 mm.

The disengagement-preventing structure 61 preferably comprises a circumferentially-extending projection 61*a* formed on the lower portion of the inner circumferential surface of the contact-preventing member 33, and a circumferentially-extending recess 61*b* formed in the lower portion of the outer surface 60*b* of the stepped portion 60 which is the outer circumferential surface of the mounting protrusion 34. The positional relationship between the projection 61*a* and the recess 61*b* may be reversed. That is to say, the projection may be formed on the outer surface of the stepped portion 60, and the recess in the inner surface of the contact-preventing member 33. The vertical width of the recess 61*b* may be slightly greater than that of the projection 61*a* so that a slight vertical movement of the contact-preventing member 33 is allowed. The expansion-preventing members 62 are made of a metallic plate and formed, for example, to have a curved surface having a predetermined length (e.g., 20 mm) along the outer surface of the lid 15. The expansion-preventing members 62 are each fixedly mounted on the outer surface of the lid 15 via at least one pair of right and left fixing screws 63. As previously described with reference to in FIG. 7 in connection with the first embodiment, one of the expansion-preventing members 62 is preferably disposed so as to bridge the gap (i.e., the cutout 36) between the free ends 33*a* and 33*b* of the contact-preventing member 33, whereby radial outward expansion of the free ends 33*a* and 33*b* can be prevented more effectively. In addition, preferably, a circumferential positioning protrusion 62*a* is provided on the aforementioned one expansion-preventing member 62. The circumferential positioning protrusion 62*a* is inserted into the cutout 36 between the free ends 33*a* and 33*b* of the contact-preventing member 33 while leaving gaps between the circumferential positioning protrusion 62*a* and the free ends 33*a* and 33*b*. The circumferential positioning protrusion 62*a* prevents such an amount of rotation the contact-preventing member 33 that one of the free ends 33*a* and 33*b* is removed from the expansion-preventing member 62, but allows a limited amount of rotation of the contact-preventing member 33. Thus, thermal expansion of the contact-preventing member 33 can still be absorbed due to provision of the gaps between the circumferential positioning protrusion 62*a* and the free ends 33*a* and 33*b*.

In this modification, the stepped portion 60 is formed on the peripheral portion of the lid 15 outside the O-ring 32, the contact-preventing member 33 engages with the stepped portion 60, the upward-disengagement preventing structure 61 for preventing upward movement of the contact-preventing member 61 is provided on the outer circumferential surface 60*b* of the stepped portion 60 and on the inner circumferential surface of the contact-preventing member 33, and a plurality of expansion-preventing members 62 are provided on the outer circumferential surface of the lid 15 at intervals to prevent outward expansion of the contact-preventing member 33. Thus, the contact-preventing member 33 may be formed into a simple shape avoiding stress concentration, and a wide pressure-bearing area of the contact-preventing member 33 is ensured, achieving a longer working life of the contact-preventing member 33.

Figure 12:
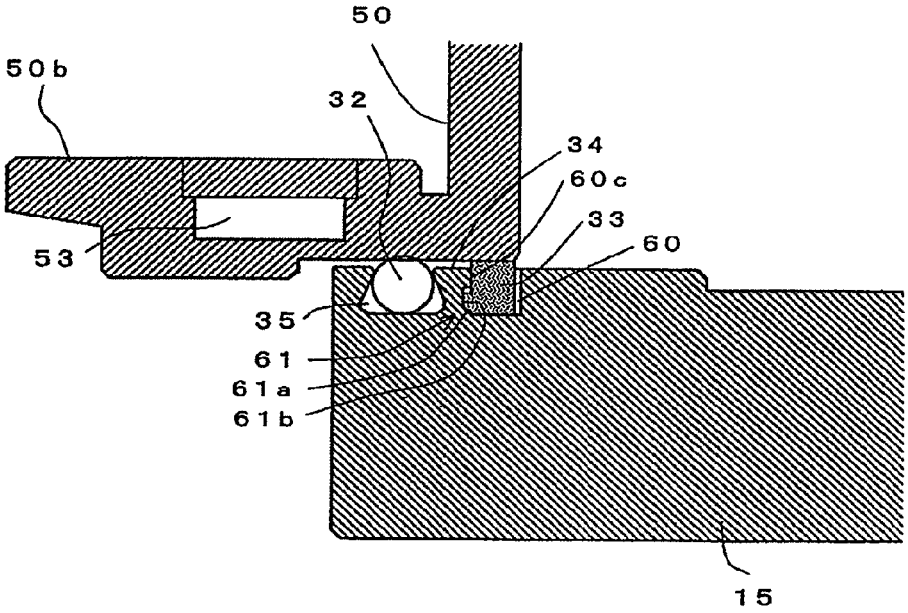
FIG. 12 is a cross-sectional view showing yet another modification of the mounting structure for the contact-preventing member.
Figure 13:
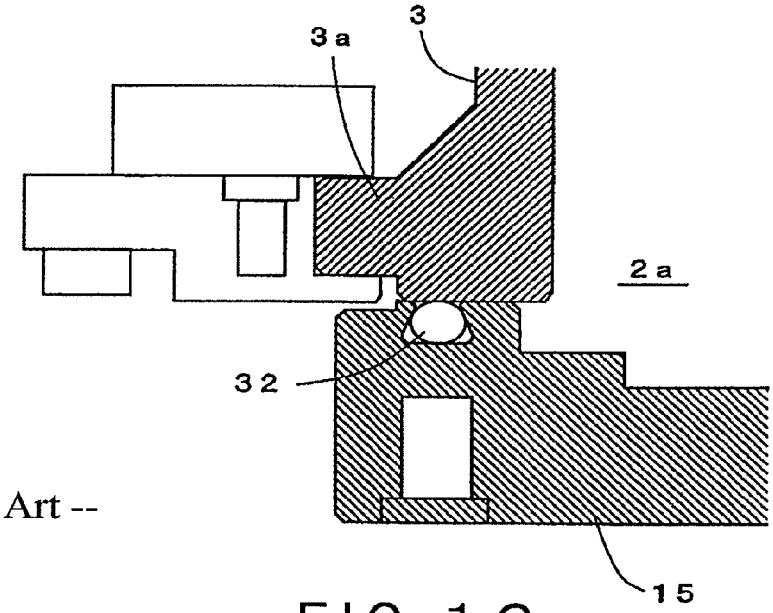
FIG. 13 is a cross-sectional view showing a main part of a conventional heat treatment apparatus.
Figure 14:
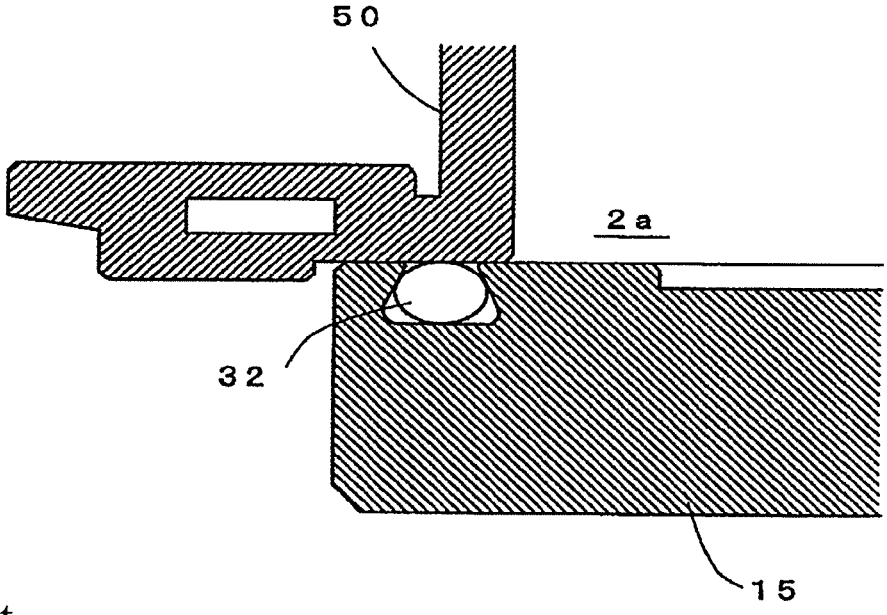
FIG. 14 is a cross-sectional view showing a main part of another conventional heat treatment apparatus.

FIG. 12 is a cross-sectional view showing yet another modification of the mounting structure for the contact-preventing member. In this modification, substantially the same elements as those of shown in FIG. 11 are assigned the same reference numbers and duplicative description is omitted. In the modification of FIG. 12, the lid 15 has, on a peripheral portion thereof inside the O-ring 32, a stepped portion 60 with which the contact-preventing member 33 engages. Additionally, there is provided a disengagement-preventing structure 61, for preventing upward movement (disengagement) of the contact-preventing member 33, which comprises engagement portions respectively formed on an inner surface 60*c* of the stepped portion 60 and on an inner surface of the contact-preventing member 33 for mutual engagement. The disengagement-preventing structure 61 preferably comprises a circumferentially-extending projection 61*a* formed on the lower portion of the outer circumferential surface of the contact-preventing member 33, and a circumferentially-extending recess 61*b* formed in the lower portion of the inner circumferential surface 60*c* of the stepped portion 60. The positional relationship between the projection 61*a* and the recess 61*b* may be reversed. In this modification, substantially the same advantageous effects as those of the modification in FIG. 11 can also be achieved. No expansion-preventing members are required since the inner surface 60*c* of the stepped portion 60 prevents expansion of the contact-preventing member 33.

While embodiments of the present invention have been described in detail with reference to the accompanying drawings, the invention is not limited to the above embodiments and various design changes and modifications may be conducted within the spirit and scope of the invention. For example, the process objects may be glass substrates, LCD substrates, or the like.

The invention claimed is:

1. A heat treatment apparatus comprising:

a processing vessel adapted to accommodate process objects therein to perform a heat treatment to the process objects under reduced pressure, the processing vessel having a furnace throat at a bottom thereof and the processing vessel having a vessel main body made of quartz;

a metallic lid adapted to support thereon a holder for holding a plurality of process objects so as to load and unload the holder into and from the processing vessel and to close and open the furnace throat; and an annular sealing member disposed on the lid to seal a gap between the lid and the furnace throat, wherein a contact-preventing member is disposed between the lid and the furnace throat to prevent contact of the lid with the furnace throat due to squashing of the sealing member that would otherwise occur when an internal pressure of the processing vessel is reduced, and the contact-preventing member is disposed inside the sealing member.

2. The heat treatment apparatus according to claim 1, wherein the processing vessel has a metallic throat member connected to a lower portion of the vessel main body to provide the furnace throat.

3. The heat treatment apparatus according to claim 1, wherein the processing vessel is constituted such that a lower end portion of the vessel main body made of quartz provides the furnace throat.

4. The heat treatment apparatus according to claim 1, wherein the contact-preventing member is formed of a heat-resistant resin.

5. A heat treatment apparatus comprising:

a processing vessel adapted to accommodate process objects therein to perform a heat treatment to the process objects under reduced pressure, the processing vessel having a furnace throat at a bottom thereof and the processing vessel having a vessel main body made of quartz;

a metallic lid adapted to support thereon a holder for holding a plurality of process objects so as to load and unload the holder into and from the processing vessel and to close and open the furnace throat; and an annular sealing member disposed on the lid to seal a gap between the lid and the furnace throat, wherein a contact-preventing member is disposed between the lid and the furnace throat to prevent contact of the lid with the furnace throat due to squashing of the sealing member that would otherwise occur when an internal pressure of the processing vessel is reduced, and the contact-preventing member has an annular shape and has a cutout to absorb circumferential thermal expansion of the contact-preventing member.

6. A heat treatment apparatus comprising:

a processing vessel adapted to accommodate process objects therein to perform a heat treatment to the process objects under reduced pressure, the processing vessel having a furnace throat at a bottom thereof and the processing vessel having a vessel main body made of quartz;

a metallic lid adapted to support thereon a holder for holding a plurality of process objects so as to load and unload the holder into and from the processing vessel and to close and open the furnace throat; and an annular sealing member disposed on the lid to seal a gap between the lid and the furnace throat, wherein a contact-preventing member is disposed between the lid and the furnace throat to prevent contact of the lid with the furnace throat due to squashing of the sealing member that would otherwise occur when an internal pressure of the processing vessel is reduced, an engagement projection, for preventing disengagement of the contact-preventing member from the lid, is formed at a lower portion of the contact-preventing member, the engagement projection extends circumferentially, and the engagement projection has a downward projecting part and a radially outward projecting part projecting from the downward projecting part, and an annular engagement groove, with which the engagement projection is detachably engaged, is formed at an upper portion of the lid.

7. A heat treatment apparatus comprising:

a processing vessel adapted to accommodate process objects therein to perform a heat treatment to the process objects under reduced pressure, the processing vessel having a furnace throat at a bottom thereof and the processing vessel having a vessel main body made of quartz;

a metallic lid adapted to support thereon a holder for holding a plurality of process objects so as to load and unload the holder into and from the processing vessel and to close and open the furnace throat; and an annular sealing member disposed on the lid to seal a gap between the lid and the furnace throat, wherein a contact-preventing member is disposed outside the sealing member, and is also between the lid and the furnace throat to prevent contact of the lid with the furnace throat due to squashing of the sealing member that would otherwise occur when an internal pressure of the processing vessel is reduced, and a disengagement-preventing member is attached to an outer side of the lid, and the disengagement-preventing member engages with an engagement groove formed in an outer side of the contact-preventing member to prevent the contact-preventing member from being removed from the lid.

8. A heat treatment apparatus comprising:

a processing vessel adapted to accommodate process objects therein to perform a heat treatment to the process objects under reduced pressure, the processing vessel having a furnace throat at a bottom thereof and the processing vessel having a vessel main body made of quartz;

a metallic lid adapted to support thereon a holder for holding a plurality of process objects so as to load and unload the holder into and from the processing vessel and to close and open the furnace throat; and an annular sealing member disposed on the lid to seal a gap between the lid and the furnace throat, wherein a contact-preventing member is disposed outside the sealing member, and is also between the lid and the furnace throat to prevent contact of the lid with the furnace throat due to squashing of the sealing member that would otherwise occur when an internal pressure of the processing vessel is reduced, the contact-preventing member has an annular shape and has a cutout to absorb circumferential thermal expansion of the contact-preventing member, a stepped portion is formed on a peripheral portion of the lid outside the sealing member, the contact-preventing member engaging with the stepped portion, an upward-disengagement preventing structure for preventing upward movement of the contact-preventing member being provided on an outer circumferential surface of the stepped portion and on an inner circumferential surface of the contact-preventing member, and a plurality of expansion-preventing members are provided on an outer circumferential surface of the lid at intervals to prevent outward expansion of the contact-preventing member.

* * * * *